US007624578B2

(12) United States Patent
Hadley

(10) Patent No.: US 7,624,578 B2
(45) Date of Patent: Dec. 1, 2009

(54) METHOD AND APPARATUS FOR GENERATING COMBUSTION PRODUCTS WITHIN A GAS TURBINE ENGINE

(75) Inventor: Mark Allan Hadley, Greenville, SC (US)

(73) Assignee: General Electric Company, Schenectady, NY (US)

( * ) Notice: Subject to any disclaimer, the term of this patent is extended or adjusted under 35 U.S.C. 154(b) by 46 days.

(21) Appl. No.: 11/241,391

(22) Filed: Sep. 30, 2005

(65) Prior Publication Data

US 2007/0245740 A1 Oct. 25, 2007

(51) Int. Cl.
*F02C 1/00* (2006.01)
*F02G 3/00* (2006.01)

(52) U.S. Cl. ..... 60/754; 60/737

(58) Field of Classification Search ..... 60/776, 60/737, 753, 754, 738, 750, 760
See application file for complete search history.

(56) References Cited

U.S. PATENT DOCUMENTS 4,191,011 A 3/1980 Sweeney et al.
4,280,329 A * 7/1981 Rackley et al. ..... 60/754
4,301,656 A 11/1981 Stettler
4,549,402 A * 10/1985 Saintsbury et al. ..... 60/738
4,928,481 A * 5/1990 Joshi et al. ..... 60/737
5,415,000 A 5/1995 Mumford et al.
5,720,163 A 2/1998 Pfefferle et al.
6,122,916 A 9/2000 Amos et al.
6,182,436 B1 * 2/2001 Prociw et al. ..... 60/776
6,594,999 B2 * 7/2003 Mandai et al. ..... 60/722
6,631,614 B2 10/2003 Mandai et al.
6,634,175 B1 10/2003 Kawata et al.
6,715,295 B2 4/2004 Gadde et al.
7,010,923 B2 3/2006 Mancini et al.

* cited by examiner

*Primary Examiner*—Michael Cuff
*Assistant Examiner*—Andrew Nguyen
(74) *Attorney, Agent, or Firm*—Armstrong Teasdale LLP

(57) ABSTRACT

A method for generating combustion products within a gas turbine engine includes directing an internal air/fuel mixture towards a stagnation point in close proximity to an inner surface of a porous wall defining a combustion chamber. The internal air/fuel mixture is ignited to generate combustion products including a pilot flame. A quantity of air is externally mixed with a quantity of fuel to produce an external air/fuel mixture. The external air/fuel mixture is directed through the porous wall and into the combustion chamber such that the external air/fuel mixture is ignited by the pilot flame. A direction of flow of the combustion products is reversed at the stagnation point.

20 Claims, 3 Drawing Sheets

METHOD AND APPARATUS FOR GENERATING COMBUSTION PRODUCTS WITHIN A GAS TURBINE ENGINE

BACKGROUND OF THE INVENTION

This invention relates generally to gas turbine engines, and more particularly, to methods and apparatus for controlling the operation of gas turbine engines.

Gas turbine engines typically include a compressor section, a combustor section, and at least one turbine section. The compressor compresses air, which is mixed with fuel and channeled to the combustor. The mixture is then ignited to generate hot combustion gases. The combustion gases are channeled to the turbine which extracts energy from the combustion gases for powering the compressor, as well as producing useful work to power a load, such as an electrical generator, or to propel an aircraft in flight.

Gas turbine engines operate in many different operating conditions, and combustor performance facilitates engine operation over a wide range of engine operating conditions. Controlling combustor performance facilitates improving overall gas turbine engine operations.

BRIEF DESCRIPTION OF THE INVENTION

In one aspect, the present invention provides a method for generating combustion products within a gas turbine engine. The method includes directing an internal air/fuel mixture towards a stagnation point in close proximity to an inner surface of a porous wall defining a combustion chamber. The internal air/fuel mixture ignites to generate combustion products including a pilot flame. A quantity of air is externally mixed with a quantity of fuel external to the porous wall to produce an external air/fuel mixture. The external air/fuel mixture is directed through the porous wall and into the combustion chamber such that the external air/fuel mixture is ignited by the pilot flame. A direction of flow of the combustion products is reversed at the stagnation point.

In another aspect, a combustor assembly is provided. The combustor assembly includes a porous wall defining a combustion chamber. At least one burner is positioned at least partially within the combustion chamber. The burner directs an internal air/fuel mixture towards a stagnation point in close proximity to an inner surface of the porous wall to produce a pilot flame. An external air/fuel mixture source is positioned external to the combustion chamber. The external air/fuel mixture source directs an external air/fuel mixture though the porous wall such that the external air/fuel mixture is ignited by the pilot flame and a flow of combustion products is reversed at the stagnation point.

In yet another aspect, the present invention provides a gas turbine engine including a compressor that discharges a flow of air. A combustor assembly is positioned downstream from the compressor. The combustor assembly includes a porous wall that defines a combustion chamber. At least one burner is positioned at least partially within the combustion chamber. The burner directs an internal air/fuel mixture towards a stagnation point in close proximity to an inner surface of the porous wall to produce a pilot flame at a flow reversal point. A plurality of fuel sources are positioned external to the combustion chamber. Each fuel source discharges a quantity of fuel that mixes with the flow of air to form an external air/fuel mixture. The external air/fuel mixture is directed though the porous wall such that the external air/fuel mixture is ignited by the pilot flame and a flow of combustion products is reversed at the stagnation point.

DETAILED DESCRIPTION OF THE INVENTION

The present invention is directed to a method and a combustion assembly for lowering combustor wall temperatures, thereby lowering gas turbine engine CO and $NO_x$ emissions and improving gas turbine engine turndown capabilities. The present invention is described below in reference to its application in connection with and operation of a gas turbine engine. However, it will be obvious to those skilled in the art and guided by the teachings herein provided that the invention is likewise applicable to any combustion device including, without limitation, boilers, heaters and other turbine engines, and may be applied to systems consuming natural gas, fuel, coal, oil or any solid, liquid or gaseous fuel.

As used herein, references to "combustion" are to be understood to refer to a chemical process wherein oxygen, e.g., air, combines with the combustible elements of fuel, namely carbon, hydrogen and sulfur, at an elevated temperature sufficient to ignite the constituents.

Figure 1:
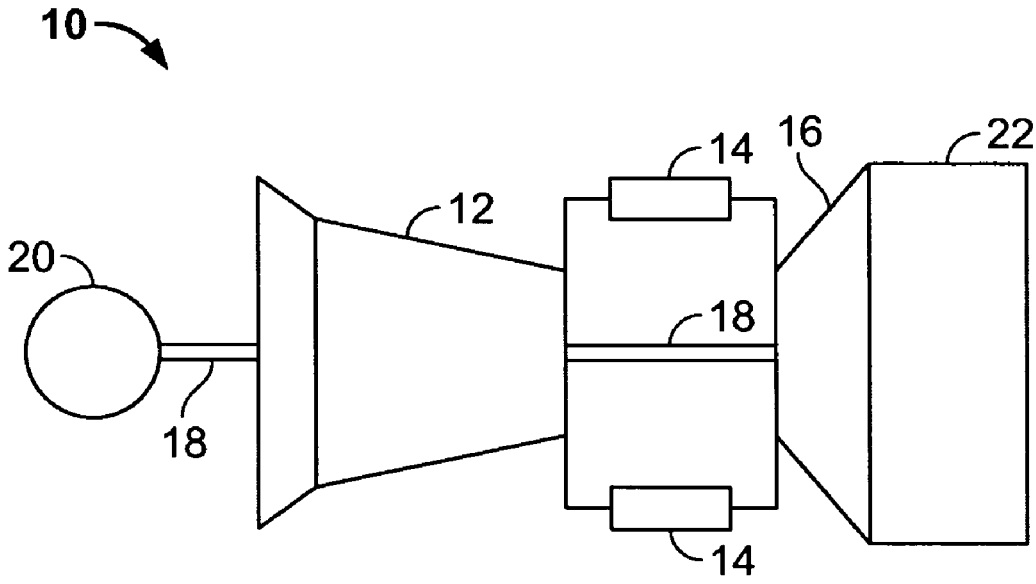
FIG. 1 is a schematic illustration of an exemplary gas turbine engine, according to one embodiment of this invention.

FIG. 1 is a schematic illustration of an exemplary gas turbine engine 10 including at least one compressor 12, a combustor assembly 14 and a turbine 16 connected serially. In the exemplary embodiment, compressor 12 and turbine 16 are coupled by a shaft 18, which also couples turbine 16 and a driven load 20. Engine 10 illustrated and described herein is exemplary only. Accordingly, engine 10 is not limited to the gas turbine engine shown in FIG. 1 and described herein, but rather, engine 10 may be any suitable turbine engine.

In operation, air flows into engine 10 through compressor 12 and is compressed. Compressed air is mixed with fuel to form an air/fuel mixture that is channeled to combustor assembly 14 where the air/fuel mixture is ignited. Combustion products or gases from combustor assembly 14 drive rotating turbine 16 about shaft 18 and exits gas turbine engine 10 through an exhaust nozzle 22.

Figure 2:
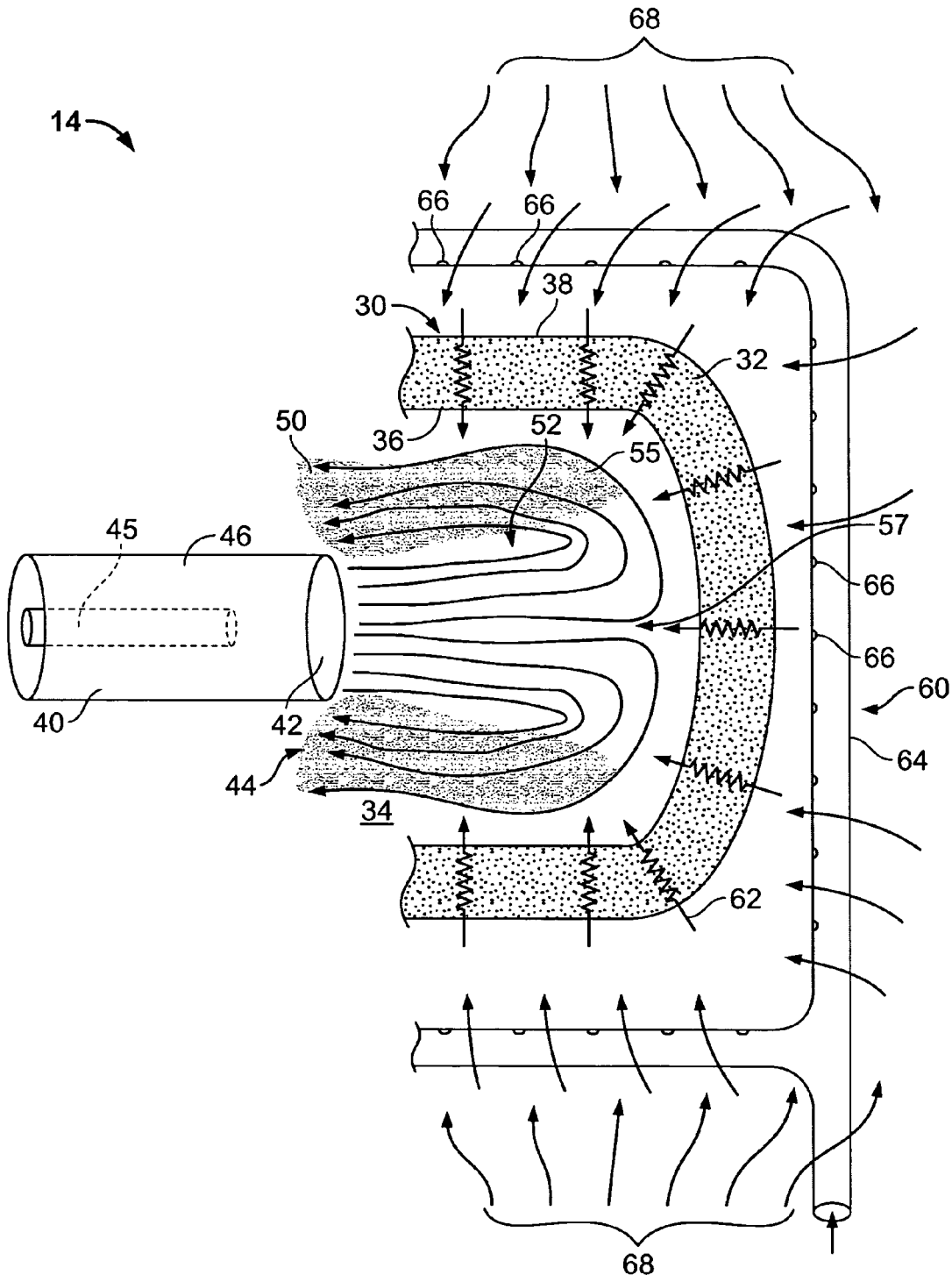
FIG. 2 is a schematic partial view of an exemplary combustor assembly incorporated within a gas turbine engine, according to one embodiment of this invention.

FIG. 2 is a schematic illustration of an exemplary combustor assembly 14 incorporated within gas turbine engine 10. In one embodiment, combustor assembly 14 includes a shell 30 having a porous wall 32 that defines a combustion chamber 34 within porous wall 32. Porous wall 32 defames an inner surface 36 and an outer surface 38 of shell 30. Further, in this embodiment, porous wall 32 has a generally cylindrical configuration with porous wall 32 having a generally circular cross-sectional shape. In alternative embodiments, porous wall 32 has any suitable geometric configuration.

Porous wall 32 is fabricated from any suitably porous material including, without limitation, TRANSPLY materials, sintered metal materials, such as available from Mott Metallurgical located in Farmington, Conn., and/or ceramic materials, such as available from Alzeta Corporation located in Santa Clara, Calif., zirconia, and alumina. It is apparent to those skilled in the art and guided by the teachings herein provided that porous wall 32 can be constructed or fabricated from any suitably porous material that allows fluidic flow through porous wall 32, as discussed in greater detail below.

As shown in FIG. 2, at least one burner 40 is at least partially positioned within combustion chamber 34 such that an opening 42 formed at an end portion of burner 40 is positioned within and in fluidic communication with combustion chamber 34. Burner 40 provides a combustible internal air/fuel mixture 44 through opening 42 to combustion chamber 34. In one embodiment, burner 40 includes a fuel inlet 45 in communication with chamber 34 at opening 42 to supply a continuous flow of suitable fuel to combustion chamber 34. An air inlet 46 is positioned coaxially about fuel inlet 45 and in communication with chamber 34 at opening 42 to supply a continuous flow of air to combustion chamber 34. The air supplied through air inlet 46 mixes at or near opening 42 with the fuel supplied through fuel inlet 45 to form internal air/fuel mixture 44.

Within combustion chamber 34, combustible internal air/fuel mixture 44 is initiated to combust. During the combustion process, the internal air/fuel mixture 44 flows with respect to a pilot flame 50 at a flow reversal point 52 positioned at opening 42 to generate combustion products 55. As shown in FIG. 2, burner 40 directs internal air/fuel mixture 44 and/or combustion products 55 at inner surface 36. In one embodiment, internal air/fuel mixture 44 and/or combustion products 55 are directed towards a stagnation point 57 in close proximity to inner surface 36. Stagnation point 57 may or may not generally correspond with flow reversal point 52. The term "stagnation point" refers to a point or region where an average or net velocity of internal air/fuel mixture 44 and/or combustion products 55 is zero. Further, the phrase "in close proximity to" refers to stagnation point 57 being at, adjacent or near inner surface 36. In one particular embodiment, during the combustion process, stagnation point 57 contacts inner surface 36.

In one embodiment, combustion assembly 14 includes a plurality of burners 40 positioned about inner surface 36. For example, at least about 30 burners are positioned circumferentially about inner surface 36, with each burner 40 providing a determined quantity of internal air/fuel mixture 44.

Combustion assembly 14 also includes an external air/fuel mixture source 60 positioned with respect to shell 30. External air/fuel mixture source 60 directs a flow of a combustible external air/fuel mixture 62 though porous wall 32. Reactants contained within external air/fuel mixture 62 mix with internal air/fuel mixture 44 and/or combustion products 55 and ignite upon entrance into combustion chamber 34. In one embodiment, the flow of external air/fuel mixture 62 is substantially constant through porous wall 32 and into combustion chamber 34. Further, a quantity of air and/or a quantity of fuel mixed to form external air/fuel mixture 62 is controllably adjustable to adjust a stoichiometry of external air/fuel mixture 62 to prevent or limit CO emissions from combustion assembly 14.

Referring to FIG. 2, in one embodiment, external air/fuel mixture source 60 includes a fuel source 64, such as a pipe, positioned with respect to porous wall 32. Fuel source 64 includes a plurality of fuel ports 66 positioned about outer surface 38 of porous wall 32 and directed at porous wall 32. A determined quantity of fuel is discharged from each fuel port 66. An external air source 68 is directed to flow across or with respect to fuel source 64 to mix with the fuel discharged from each fuel port 66 to form external air/fuel mixture 62. Upon mixing of the air with the discharged fuel, external air/fuel mixture 62 is directed through porous wall 32 and into combustion chamber 34.

Figure 3:
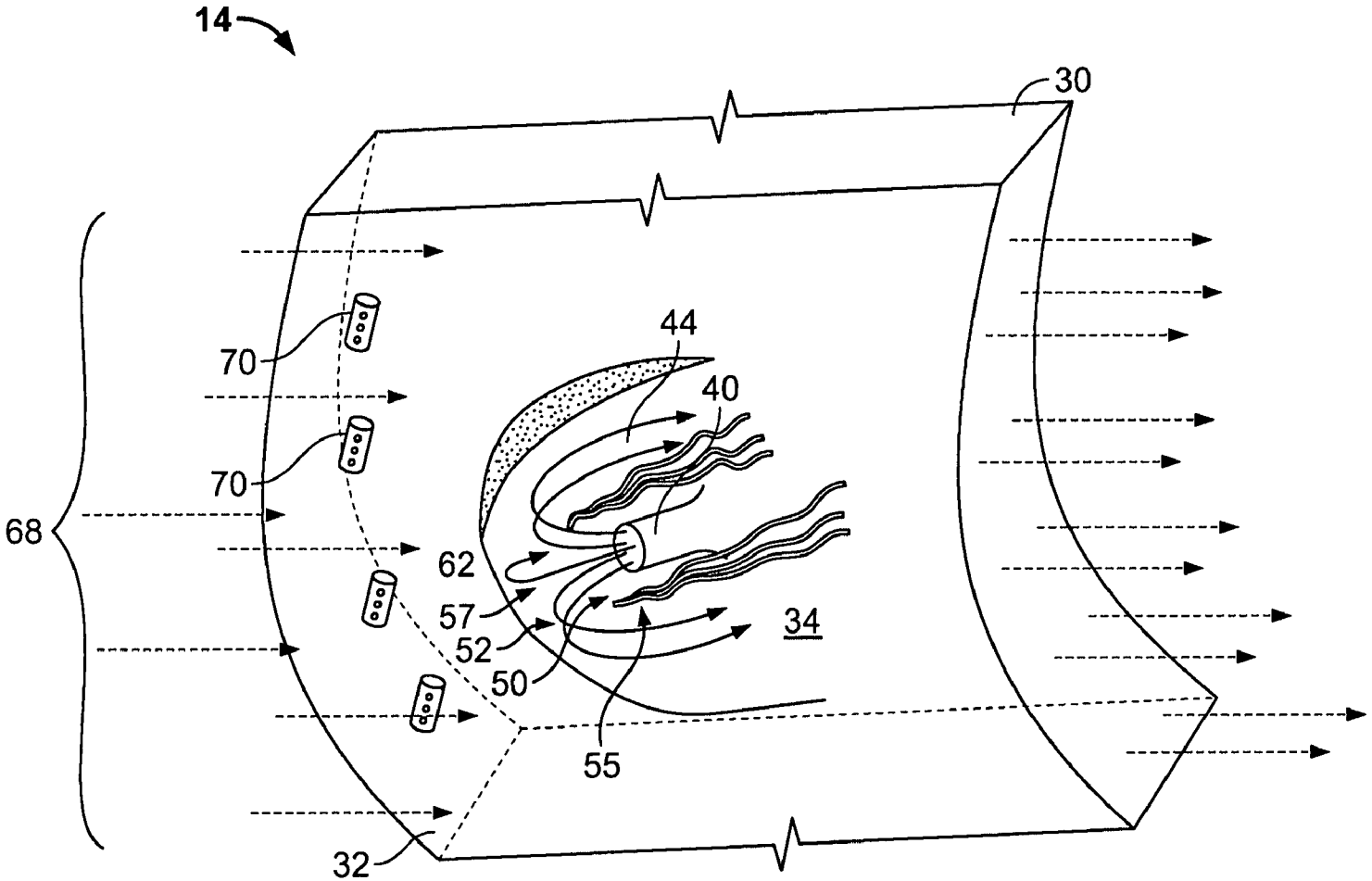
FIG. 3 is a schematic partial view of an exemplary combustor assembly incorporated within a gas turbine engine, according to one embodiment of this invention.

Referring to FIG. 3, in an alternative embodiment, external air source 68 includes a supply of air discharged from compressor 12 (not shown in FIG. 3), which is in communication with combustion assembly 14. External air source 68 is directed to flow across or with respect to a plurality of premixing pegs 70 positioned with respect to shell 30. Each premixing peg 70 discharges a determined quantity of suitable fuel, which mixes with the air as the air flow across premixing peg 70 to form external air/fuel mixture 62. External air/fuel mixture 62 is then directed through porous wall 32 and into combustion chamber 34.

As external air/fuel mixture 62 flows through porous wall 32, external air/fuel mixture 62 cools porous wall 32, which reduces the overall flame temperature produced within combustion chamber 34 and prevents or limits the production of CO and/or $NO_x$. Further, within combustion chamber 34, external air/fuel mixture 62 rapidly mixes with internal air/fuel mixture 44 and/or combustion products 55, resulting in a well-mixed, stable combustion reaction between the reactants contained within external air/fuel mixture 62 and internal air/fuel mixture 44 and/or combustion products 55. The stable combustion reaction dilutes and/or spreads combustion products 55 throughout combustion chamber 34 and prevents or limits uneven temperatures within combustion chamber 34, e.g., hot and/or cold pockets or areas within combustion chamber 34, while maintaining combustion chamber 34 at or near inner surface 36 relatively cool. Additionally, combustion assembly 14 of the present invention provides improved combustion turndown capabilities, allowing turndown within a wider operating range than conventional combustors.

In one embodiment, a method for producing combustion products within combustion assembly 14 includes directing internal air/fuel mixture 44 at stagnation point 57 in close proximity to inner surface 36 of porous wall 32. Internal air/fuel mixture 44 is initiated to combust. During the combustion process, internal air/fuel mixture 44 is directed across internal pilot flame 50 to generate combustion products 55.

External to combustion chamber 34, a quantity of air is mixed with a quantity of fuel to produce external air/fuel mixture 62. In one embodiment, the flow of air is directed across a plurality of fuel sources, such as fuel ports 66 or premixing pegs 70, positioned with respect to outer surface 38 of porous wall 32. Further, the quantity of air and/or the quantity of fuel is controllably adjusted to adjust a stoichiometry of external air/fuel mixture 62. External air/fuel mixture 62 is directed through porous wall 32 and into combustion chamber 34. External air/fuel mixture 62 cools porous wall 32 as external air/fuel mixture 62 is directed through porous wall 32.

Within combustion chamber 34, external air/fuel mixture 62 mixes with internal air/fuel mixture 44 and/or combustion products 55, and a combustion reaction between external air/fuel mixture 62 and internal air/fuel mixture 44 and/or combustion products 55 is initiated to ignite external air/fuel mixture 62 within combustion chamber 36. For example, external air/fuel mixture 62 is directed across pilot flame 50 to initiate the combustion process. A direction of flow of combustion products 55, which include combustion products resulting from the combustion of internal air/fuel mixture and/or combustion products resulting from the combustion of external air/fuel mixture, is reversed at stagnation point 57. As the direction of flow is reversed, pilot flame 50 is held at flow reversal point 52 located at opening 42 of burner 40. In one embodiment, external air/fuel mixture 62 is rapidly mixed with combustion products 55 to spread the flame within combustion chamber 34. A direction of flow of the internal flame produced during the combustion process is reversed to direct combustion products 55 into turbine 16 in communication with combustion assembly 14.

The above-described method and assembly for generating combustion products within a gas turbine engine facilitates lowering gas turbine engine CO and/or $NO_x$ emissions, as well as improving gas turbine engine turndown capabilities. More specifically, the method and assembly provides a substantially constant flow of an external air/fuel mixture through the porous wall of the combustion assembly, which cools the porous wall, reduces the overall flame temperature within the combustion chamber and prevents or limits CO and/or $NO_x$ emissions. Within the combustion chamber, the external air/fuel mixture mixes with combustion products of an internal air/fuel mixture to provide a well-stirred, stable reaction between the reactants contained within the external air/fuel mixture and the combustion products.

Exemplary embodiments of a method and assembly for generating combustion products within a gas turbine engine are described above in detail. The method and assembly are not limited to the specific embodiments described herein, but rather, steps of the method and/or components of the assembly may be utilized independently and separately from other steps and/or other components described herein. Further, the described method steps and/or assembly components can also be defamed in, or used in combination with, other methods and assemblies, and are not limited to practice with only the method and assembly as described herein.

While the invention has been described in terms of various specific embodiments, those skilled in the art will recognize that the invention can be practiced with modification within the spirit and scope of the claims.

What is claimed is:

1. A method for generating combustion products within a gas turbine engine, said method comprises:

defining a first direction that is indicative of the overall direction of flow of combustion products within a combustion chamber that is defined by a porous wall, the porous wall having an upstream endwall with respect to the first direction;

directing a first, internal air/fuel mixture from a burner at least partially within the combustion chamber, wherein the direction of flow of the first air/fuel mixture exiting the burner is opposite the first direction, the first air/fuel mixture directed towards a stagnation point that is adjacent to an inner surface of the upstream endwall, wherein the porous wall is fabricated from a porous material;

igniting the first air/fuel mixture to generate combustion products including a pilot flame;

externally mixing a quantity of air with a quantity of fuel external to the porous wall to produce a second, external air/fuel mixture;

directing the second air/fuel mixture through the porous wall and into the combustion chamber such that the second air/fuel mixture is ignited by the pilot flame; and reversing a direction of flow of the combustion products at the stagnation point.

2. A method in accordance with claim 1 further comprising adjusting a stoichiometry of the external air/fuel mixture.

3. A method in accordance with claim 1 further comprising cooling the porous wall as the external air/fuel mixture is directed through the porous wall.

4. A method in accordance with claim 1 further comprising mixing the external air/fuel mixture with the combustion products and igniting the external air/fuel mixture within the combustion chamber.

5. A method in accordance with claim 4 further comprising rapidly mixing the external air/fuel mixture with the combustion products to spread the combustion products within the combustion chamber.

6. A method in accordance with claim 1 wherein externally mixing a quantity of air with a quantity of fuel to produce an external air/fuel mixture further comprises directing a flow of air across a plurality of fuel sources positioned with respect to an outer surface of the porous wall.

7. A method in accordance with claim 1 wherein initiating a combustion reaction between the external air/fuel mixture and the combustion products further comprises directing the external air/fuel mixture across the pilot flame.

8. A method in accordance with claim 1 further comprising directing a flow of the combustion products towards a turbine in communication with the combustion chamber.

9. A combustor assembly comprising:

a first direction that is indicative of the overall direction of flow of combustion products within a combustion chamber that is defined by a porous wall, said porous wall fabricated from a porous material and comprising an upstream endwall with respect to the first direction;

at least one burner positioned at least partially within said combustion chamber, said at least one burner directing a first internal air/fuel mixture in a direction opposite the first direction towards a stagnation point that is adjacent to an inner surface of said upstream endwall to produce a pilot flame; and a second external air/fuel mixture source positioned external to said combustion chamber, said second air/fuel mixture source for directing an external air/fuel mixture though said porous wall such that said second air/fuel mixture is ignited by said pilot flame and a flow of combustion products is reversed at said stagnation point.

10. A combustor assembly in accordance with claim 9 wherein said porous wall comprises a cylinder.

11. A combustor assembly in accordance with claim 9 wherein said flow reversal point is positioned at an opening formed in said burner.

12. A combustor assembly in accordance with claim 9 further comprising a plurality of burners positioned about said inner surface of said porous wall.

13. A combustor assembly in accordance with claim 9 wherein said flow of external air/fuel mixture is substantially constant.

14. A combustor assembly in accordance with claim 9 wherein said external air/fuel mixture source further comprises:

at least one source of air discharged from a compressor in communication with said combustor assembly; and a plurality of premixing pegs positioned with respect to the chamber and in fluidic communication with said at least one source of air, the discharged air mixing with a quantity of fuel discharged from each premixing peg of said plurality of premixing pegs and forming said external air/fuel mixture.

15. A combustor assembly in accordance with claim 9 wherein said external air/fuel mixture source further comprises:

a fuel source positioned about said porous wall, said fuel source forming a plurality of fuel ports directed at said porous wall, a quantity of fuel discharged from each fuel port of said plurality of fuel ports; and an external air source, said external air source directing a quantity of air at said quantity of fuel to form said external air/fuel mixture.

16. A combustor assembly in accordance with claim 9 wherein said at least one burner further comprises:

a fuel inlet in communication with the chamber, said fuel inlet providing fuel in a direction towards said inner surface; and an air inlet positioned coaxially about said fuel inlet and in communication with the chamber, said air inlet providing air in a direction towards said inner surface.

17. A gas turbine engine comprising:

a compressor discharging a flow of air; and a combustor assembly positioned downstream from said compressor, said combustor assembly comprising:

a first direction that is indicative of the overall direction of flow of combustion products within a combustion chamber that is defined by a porous wall, said porous wall fabricated from a porous material and comprising an upstream endwall with respect to the first direction;

at least one burner positioned at least partially within said combustion chamber, said at least one burner directing a first internal air/fuel mixture in a direction opposite the first direction towards a stagnation point that is adjacent to an inner surface of said upstream endwall to produce a pilot flame at a flow reversal point; and a plurality of fuel sources positioned external to said combustion chamber, each fuel source of said plurality of fuel sources discharging a quantity of fuel, said flow of air mixing with said quantity of fuel to form a second, external air/fuel mixture, said second air/fuel mixture directed though said porous wall such that said second air/fuel mixture is ignited by said pilot flame and a flow of combustion products is reversed at said stagnation point.

18. A gas turbine engine in accordance with claim 17 further comprising a plurality of burners positioned circumferentially about said inner surface of said porous wall.

19. A gas turbine engine in accordance with claim 17 wherein each external fuel source of said plurality of external fuel sources includes a premixing peg positioned with respect to said combustion chamber and in flow communication with said flow of air, said flow of air mixing with a quantity of fuel discharged from each premixing peg to form said external air/fuel mixture.

20. A gas turbine engine in accordance with claim 17 wherein said plurality of external fuel sources includes a plurality of fuel ports formed in a pipe positioned about said porous wall, each fuel port of said plurality of fuel ports directed at said porous wall, said flow of air mixing with a quantity of fuel discharged from each fuel port to form said external air/fuel mixture.

* * * * *

UNITED STATES PATENT AND TRADEMARK OFFICE

CERTIFICATE OF CORRECTION

PATENT NO. : 7,624,578 B2
APPLICATION NO. : 11/241391
DATED : December 1, 2009
INVENTOR(S) : Mark Allan Hadley It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 254 days.

Signed and Sealed this

Twenty-first Day of December, 2010

David J. Kappos

David J. Kappos
*Director of the United States Patent and Trademark Office*